US008220448B1

(12) United States Patent
Moggo

(10) Patent No.: US 8,220,448 B1
(45) Date of Patent: Jul. 17, 2012

(54) ARCHERY BOW STABILIZER

(76) Inventor: William R. Moggo, Howard City, MI (US)

( * ) Notice: Subject to any disclaimer, the term of this patent is extended or adjusted under 35 U.S.C. 154(b) by 277 days.

(21) Appl. No.: 12/799,499

(22) Filed: Apr. 27, 2010

(51) Int. Cl.
*F41B 5/20* (2006.01)

(52) U.S. Cl. ..... 124/89; 446/233

(58) Field of Classification Search ..... 124/89; 446/233
See application file for complete search history.

(56) References Cited

U.S. PATENT DOCUMENTS

| | | | | |
|---|---|---|---|---|
| 3,502,062 | A | 3/1970 | Shurts | |
| 4,245,612 | A | 1/1981 | Finlay | |
| 5,524,602 | A * | 6/1996 | Papandrea et al. | 124/89 |
| 5,535,731 | A | 7/1996 | Webster | |
| 5,619,981 | A | 4/1997 | Breedlove | |
| 5,803,070 | A | 9/1998 | Martin et al. | |
| 6,030,272 | A * | 2/2000 | Hu | 446/233 |

* cited by examiner

*Primary Examiner* — John Ricci
(74) *Attorney, Agent, or Firm* — Paul R. Martin

(57) ABSTRACT

A stabilizer for an archery bow includes a motor-driven gyroscope located inside a tube which is mounted on the bow. The stabilizer screws into front of bow where traditional stabilizer/vibration dampeners usually attach. The stabilizer of the present invention has an electric motor powered gyroscope.

6 Claims, 1 Drawing Sheet

ARCHERY BOW STABILIZER

TECHNICAL FIELD OF THE INVENTION

The present invention relates to the general art of archery, and to the particular field of archery bow stabilizers.

BACKGROUND OF THE INVENTION

Recent years have seen an increased interest in the field of archery in general, and in target archery and hunting in particular. The accurate use of an archery bow is a skill which very nearly approaches an art form. It is generally considered to be considerably more difficult to shoot an archery bow accurately than a firearm, as the projectile (arrow) generally has a much higher percentage of mass in comparison to the bow than does a bullet to a gun, and the speed of the arrow is comparatively much less.

An archery bow moves or vibrates in response to the forces generated upon release of the bow string from its drawn position to fire an arrow. According to well known principles of physics, as the string and arrow move toward the target, the bow tends to move in the opposite direction toward the archer. Similarly, when the bow string reverses direction immediately following departure of the arrow, the bow tends to move in the direction of the target. Such reactive forces have a tendency to cause the bow to tip slightly upwardly and downwardly since the center of mass of the bow is typically located above the archer's grip on the riser. Obviously, any tipping of the bow during release of the arrow undesirably deflects the arrow from its intended trajectory toward the target.

A further unavoidable occurrence following the archer's release of an arrow has been the tendency of the bow to be laterally and rotationally displaced, that is, the handle section of the bow moves in a vibrating manner in a direction away from the arrow as it passes around the bow handle. Inasmuch as the ultimate cast of the arrow is affected throughout the time the bow string is moving from its retracted position to its forward most position due to the constant pressure exerted on the arrow notch by the bow string, it follows that any concurrent rotational displacement of the handle section or arrow rest of the bow during this period must ultimately affect the resulting cast of the arrow. Furthermore, investigation into the physical aspects of arrow launch has been undertaken to effect techniques to improve the archer's accuracy. These investigations have shown that some archers torque the bow off target line by involuntary muscular reaction during arrow cast. Torque and resulting bow movement is also produced by a physical reactive effect known as the "archer's paradox". Briefly, just prior to arrow release, the forward portion of the arrow is physically resting against the bow at the arrow plate and the arrow nock at the rear is engaging the bow string with the archer's fingers embracing the arrow and holding the drawn string. At release, the bow string rolls slightly to the left off of the archer's fingers and the arrow nock moves to the left with the string. The thrust of the bow draw-weight is transferred to the arrow which causes the arrow to bend and induce a torque applied against the arrow plate on the bow. This action moves the bow slightly and the arrow reverses its bend and passes from the bow at the arrow plate without touching said plate. On true center shot bows, of recent design, the torque action is somewhat reduced.

Archer's paradox also includes an effect associated with a nocked arrow being strongly pushed by a string during drawing and the point of the arrow is strongly pressed against the wall of the sight window of the handle raiser of the bow at release of the arrow. As a consequence, the arrow flexes while assuming a shape convex to the side wall of the handle raiser and, as a reaction of this first flexing, next flexes while assuming a shape concave to the side wall of the handle raiser at separation from the bow. This alternate flexing of the arrow repeats even after separation from the bow and, as a consequence, the arrow meanders during its flight towards the target.

As is clear from this initial behavior, the point of the arrow passes by the handle raiser whilst strongly pressing the arrow against the body of the bow. It is required for the main body of the archery bow to have a subtle reaction to such an initial behavior of the arrow at release. Ill reaction of the main body tends to cause unstable flight of the arrow which results in low rate of hit.

In addition to bow torquing, archers are familiar with the fact that vibration and "bow kick" upon arrow release are frequently the cause of many inaccurate shots. Vibration and bow kick are also physically discomforting to the archer engaged in frequent contests requiring many shots over a short period of time.

In addition, undesirable bow movement may tire the archer prematurely during sustained use. This is undesirable in both target shooting and hunting. Further, the vibration can create a noise which can be heard by game, which is undesirable during hunting. Thus, it is desirable to provide an archery bow stabilizer to counteract and minimize the undesirable effects of these physical reactive forces.

Prior art archery bows are typically constructed with an insert for attaching an archery bow stabilizer to the bow. Archery bow stabilizers are utilized to absorb limb vibration, add mass weight to a bow, and allow an archer to hold steadier on target by giving a desired balance to a bow. Target bow stabilizers up to three feet long are not uncommon, but hunting bow stabilizers are usually under 12 inches. Some hunting bow stabilizers may be used for storage of small accessories or survival gear.

A bow stabilizer can also be understood from principles of vibration and shock absorption. Therefore, stabilizers essentially function as a shock absorber and provide inertial stability to the bow assembly. A shock absorber can be thought of as a combination of a damping element (or "damper") and a spring element. The spring captures energy from the bow and delivers it to the damper. The damper absorbs or dissipates energy delivered from the spring. The damper may also capture and absorb energy through its direct contact with the bow.

An oscillating system stores energy by vibrating at a characteristic resonance frequency. An oscillating system may also vibrate at harmonics of the resonance frequency, i.e., twice the resonance frequency, four times the resonance frequency, etc. The resonant frequency is proportionate to a constant commonly referred to as the spring constant or spring coefficient. The spring coefficient is a measurement of the stiffness of the system. Numerically, the spring coefficient is equal to the force required to produce a unit of change in length from the equilibrium position, and is generally expressed in Newtons per meter or pounds per foot. An oscillating system also has a damping factor associated therewith which dampens or diminishes the amplitude of the oscillations over time.

When an arrow is shot, the bow becomes an oscillating system, which, like other oscillating systems, has an inherent resonant frequency at which it vibrates. Likewise, archery bow stabilizers are oscillating systems with an inherent resonant frequency associated therewith. Stabilizers typically function in a manner analogous to a mass attached to a spring on a surface which has a damping factor caused by friction between the mass and the surface. The spring transfers motional energy to the mass, and the system oscillates. The mass acts as a damper because it dissipates energy due to friction between the mass and the surface.

In the same manner, bow stabilizers generally have a spring element and a damping element. Oscillations in the bow drive oscillations in the spring element of the stabilizer. The spring element transfers energy to the damping element, which has a damping factor associated therewith that is higher than the damping factor of the spring or bow for absorbing energy. Thus, bow stabilizers absorb or dissipate energy by transferring energy from the bow to the damper through a spring element. The damper/spring stabilizer system has an inherent resonant frequency which is referred to herein as a damping frequency.

An optimum amount of energy is absorbed when the inherent resonate frequency of the system being damped is equal to the damping frequency of the damper/spring shock absorber. This is commonly referred to as "critically damped." The damping frequency of a shock absorber that has a spring and a damper is proportional to the product of the spring coefficient associated with the spring and the spring coefficient associated with the damper.

The inventor is aware of three basic types of bow stabilizers. Each can be understood as a damper/spring shock absorber.

One type of bow stabilizer is a metal tube surrounding a damping fluid or gel. The metal tube functions as a spring of almost infinite stiffness, i.e., with an almost infinite spring coefficient. The fluid or gel is the damper and absorbs energy from the metal tube. The fluid or gel may also contain a piston that moves in the fluid to further dissipate energy. Because the "spring" in such a system has a nearly infinite spring coefficient, the natural frequency of the stabilizer is higher than the resonate frequency of the system being damped. Therefore, the system is underdamped.

Another type of bow stabilizer is an elastomeric element connected to a weight. In such a system, the elastomeric element functions as both a damper and a spring. Generally, the spring coefficient in this type of bow stabilizer is low, making the natural frequency of the stabilizer less than the natural frequency of the bow, and thus, the system is overdamped.

A third type of bow stabilizer is a rod and mass system. Rod and mass stabilizers use a system of movable weights to tune the stabilizer resonant frequency to that of the natural frequency of the system. The rods act as a spring to transfer the energy of the bow to the weights. The rods are fixed at both ends, and therefore, the frequency of the vibrations are proportional to the length of the rods and various harmonics thereof. The weights function both as a damper to absorb the energy and as a tuner. The weights may be moved to various positions along the rod. If the weight is placed at an antinode of a resonant frequency of the rod, a maximum amount of energy can be absorbed. This type of bow stabilizer most closely approximates the natural frequency of the system to attain critical damping. However, it is often difficult to tune the stabilizer for critical damping. In addition, because the weights must be moveable to tune the stabilizer, the size of the weight is limited. The damping factor is a function of the mass of the damping material. Thus, most tunable rod and mass configurations do not allow for enough damping material to adequately absorb the energy once it is captured by the stabilizer.

Therefore, there is a need for a means for stabilizing an archery bow to preclude movement of the bow at the point of release of the bow string and the initiation of the flight of the arrow from the bow.

SUMMARY OF THE INVENTION

The above-discussed disadvantages of the prior art are overcome by a bow stabilizer that includes a motor-driven gyroscope located inside a tube which is mounted on the bow. The stabilizer screws into front of bow where traditional stabilizer/vibration dampeners usually attach. The stabilizer of the present invention has an electric motor powered gyroscope. The stabilizer of the present invention removes wobble and bow torque when aiming. A force is created by the gyroscope spinning inside a tube and improves accuracy by reducing side to side and up and down movement during aiming. The stabilizer of the present invention also prevents torquing of the bow.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
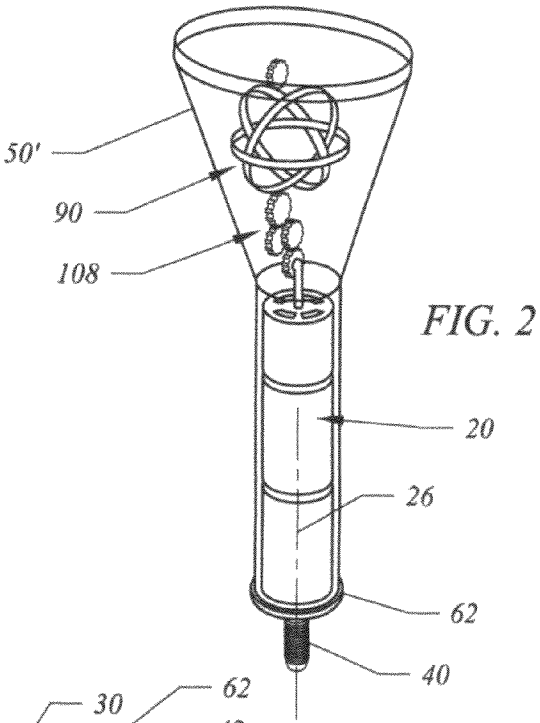
FIG. 2 is a cutaway view showing the stabilizer of the present invention.
Figure 1:
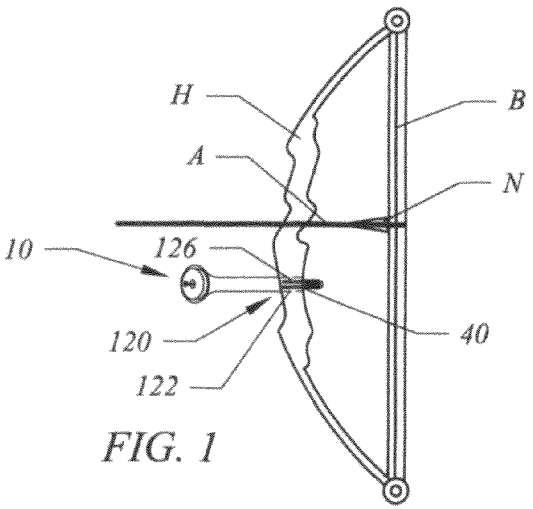
FIG. 1 shows the stabilizer embodying the principles of the present invention mounted on a bow.

Referring to the figures, it can be understood that the present invention is embodied in a stabilizer unit 10 for use on an archery bow 12 to stabilize that bow. Stabilizer unit 10 comprises a main housing 20 having a first end 22, a second end 24 and a longitudinal axis 26 extending between the first end and the second end. Main housing 20 has a hollow interior 30.

Figure 3:
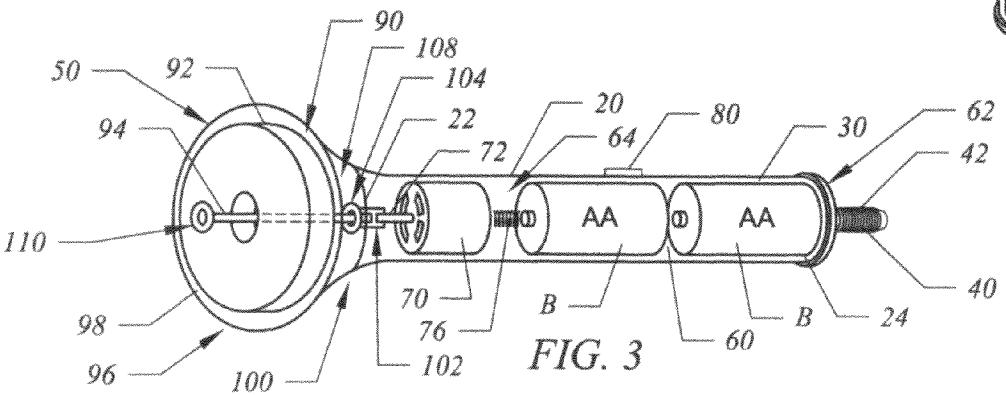
FIG. 3 is a prospective view of another form of the stabilizer of the present invention.

A bolt 40 is located on the second end of the main housing and includes external screw threads 42. The main housing further includes a hollow portion 50 on the first end of thereof. The hollow portion is larger in external size than the main housing portion and can be spherical as shown in FIG. 2 or conical as shown at 50' in FIG. 3. The shape of this portion allows it to be located in the most advantageous spot on the bow while transferring as much momentum as possible to the bow in a stabilizing manner.

A battery compartment 60 is located in the main housing to be adjacent to the second end of the main housing. Batteries B are located in the battery compartment when the stabilizer is in use. A screw cap 62 is located on the second end to provide access to the battery compartment in the main housing. A spring 64 is located in the battery compartment to secure the batteries in place.

An electric motor 70 is mounted in the main housing adjacent to the battery housing and includes an output shaft 72 which rotates when the motor is activated. An electrical connection 76 is located between the battery housing and the motor and electrically connects the batteries to the motor to apply power from batteries located in the battery housing to the motor to activate the motor and rotate the output shaft thereof. An on/off switch 80 is located on the main housing and electrically connects the motor to the battery housing to activate the motor when the on/off switch is in an "on" condition;

A gyroscope 90 is located in the hollow housing portion, and has a weight 92 mounted on a rotatable shaft 94 for rotation therewith when the shaft rotates. The hollow housing has a seam 96 which allows that housing to be opened to provide access to the gyroscope. The hollow housing can be coated with a sound insulation 98 such as rubber or the like.

A gear system 100 mechanically connects the output shaft of the motor to the rotatable shaft of the gyroscope to rotate the gyroscope shaft in conjunction with the rotation of the output shaft of the motor. The gear system includes a coupler element 102 coupled to the output shaft of the motor, a bushing 104 coupled to the coupler element, and gears 108 coupling the bushing to the shaft of the gyroscope to transfer rotation of the output shaft to the shaft of the gyroscope. A further bushing 110 is located in the hollow portion to mount the rotatable shaft of the gyroscope on the housing. The gears permit the rotation of the output shaft to be properly applied to the gyroscope shaft. Brass splined shafts can be substituted for the couplers if desired.

A mounting means 120 is located on the bow and mounts main housing 20 on the bow with the longitudinal axis of the main housing oriented to be horizontal and parallel with an arrow A when that arrow is attached to bow string B of the bow and in position to be shot from the bow. Mounting means 120 includes a bore 122 defined through handle portion H of the bow with complementary internal screw threads 126 on an archery bow being defined on the bow handle adjacent to the bore and being sized and adapted to accommodate the external threads on the bolt to mount the main housing on the bow. The location of the internally threaded bore and the length of the bolt allow the bolt to touch the bow string near a nocking point N on the bow string when the bow string is in a ready position with the arrow loaded thereonto. This provides greater stability to the unit and positions the unit in the most effective location with respect to the arrow.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A stabilizer for use on an archery bow comprising:

A) a main housing having a first end, a second end, a longitudinal axis extending between the first end and the second end, and a hollow interior;

B) a bolt on the second end of the main housing, the bolt having external screw threads which are sized and adapted to threadably engage complementary internal screw threads on an archery bow to mount the main housing on the archery bow;

C) a hollow portion on the first end of the main housing, the hollow portion being larger in external size than the main housing portion;

D) a battery compartment in the main housing adjacent to the second end of the main housing, batteries being located in the battery compartment when the stabilizer is in use;

E) a motor mounted in the main housing adjacent to the battery compartment, the motor including an output shaft which rotates when the motor is activated;

F) an electrical connection between the battery compartment and the motor to apply power from batteries located in the battery housing to the motor to activate the motor and rotate the output shaft thereof;

F) an on/off switch connecting the motor to the battery compartment to activate the motor when the on/off switch is in an "on" condition;

G) a gyroscope located in the hollow housing portion, the gyroscope having a weight mounted on a rotatable shaft for rotation therewith when the shaft rotates;

H) a gear system mechanically connecting the output shaft of the motor to the rotatable shaft of the gyroscope to rotate the gyroscope shaft in conjunction with the rotation of the output shaft of the motor, the gear system including (1) a coupler element coupled to the output shaft of the motor, (2) a bushing coupled to the coupler element, and (3) gears coupling the bushing to the shaft of the gyroscope to transfer rotation of the output shaft to the shaft of the gyroscope; and I) mounting means on the bow which mounts the main housing on the bow with the longitudinal axis of the main housing oriented to be horizontal and parallel with an arrow when that arrow is attached to a bow string of the bow and in position to be shot from the bow, the mounting means including a bore defined through a handle portion of the bow with the complementary internal screw threads on an archery bow being defined on the bow handle adjacent to the bore.

2. The stabilizer defined in claim 1 wherein the hollow portion on the main housing is spherical in shape.

3. The stabilizer defined in claim 1 wherein the hollow portion on the main housing is conical in shape.

4. The stabilizer defined in claim 1 wherein the bolt on the main housing touches the bow string near a nocking point on the bow string when the bow string is in a ready position with the arrow loaded thereonto.

5. The stabilizer defined in claim 1 further including a sound-insulation layer on the hollow housing.

6. The stabilizer defined in claim 5 further including a seam on the hollow housing which divides the hollow housing into two parts which can be separated from each other to provide access to the interior of the hollow housing.

* * * * *